US011382827B2

(12) United States Patent
Topolev

(10) Patent No.: US 11,382,827 B2
(45) Date of Patent: Jul. 12, 2022

(54) MASSAGE DEVICE COMPRISING A PRESSURE ELEMENT, METHOD FOR THE USE THEREOF, AND METHOD FOR THE MANUFACTURE THEREOF

(71) Applicant: Sergey Evgenievich Topolev, St. Petersburg (RU)

(72) Inventor: Sergey Evgenievich Topolev, St. Petersburg (RU)

( * ) Notice: Subject to any disclaimer, the term of this patent is extended or adjusted under 35 U.S.C. 154(b) by 771 days.

(21) Appl. No.: 16/321,312

(22) PCT Filed: Jul. 27, 2017

(86) PCT No.: PCT/RU2017/050062
§ 371 (c)(1),
(2) Date: Jan. 28, 2019

(87) PCT Pub. No.: WO2018/021947
PCT Pub. Date: Feb. 1, 2018

(65) Prior Publication Data

US 2019/0167513 A1 Jun. 6, 2019

(30) Foreign Application Priority Data

Jul. 28, 2016 (RU) ..... RU2016131026

(51) Int. Cl.
*A61H 19/00* (2006.01)
*A61H 23/02* (2006.01)

(52) U.S. Cl.
CPC ..... *A61H 19/44* (2013.01); *A61H 19/00* (2013.01); *A61H 23/02* (2013.01); *A61H 19/32* (2013.01); *A61H 19/34* (2013.01)

(58) Field of Classification Search
CPC .. A61H 19/34; A61H 19/32; A61H 2205/087; A61F 5/41; A61F 2005/411
See application file for complete search history.

(56) References Cited

U.S. PATENT DOCUMENTS 2,957,474 A * 10/1960 Bates ..... A61H 21/00 601/135
4,022,196 A * 5/1977 Clinton ..... A61F 5/41 600/39

(Continued)

FOREIGN PATENT DOCUMENTS

RU 2509548 C2 3/2014

*Primary Examiner* — Justine R Yu
*Assistant Examiner* — Christopher E Miller
(74) *Attorney, Agent, or Firm* — ArentFox Schiff LLP; Michael Fainberg

(57) ABSTRACT

The group of inventions relates to massage devices for personal use. The present device for massaging the genitals includes a first elongate member having a first and a second end, and a second member that is connected to the first end of the first member, wherein the first member has an arc-shaped bend and includes a first surface region that is capable of interaction with a first region of the body, and the second member includes a second surface region that is capable of interaction with a second region of the body. The first surface region is elongate with an arc-shaped bend, and is capable of translational movement along the first region of the body, the first member being capable of straightening elastically during the translational movement, thus substantially conferring the shape of the first region of the body to the first surface region.

14 Claims, 7 Drawing Sheets

(56) References Cited

U.S. PATENT DOCUMENTS 4,429,689 A * 2/1984 Yanong ..... A61F 5/41 600/39
6,036,635 A * 3/2000 Altshuler ..... A61F 5/41 600/38
6,436,031 B1 * 8/2002 Salib ..... A61F 5/41 600/39
6,749,558 B1 * 6/2004 Brintle ..... A61F 5/41 600/38
8,419,611 B1 * 4/2013 Hatami ..... A61H 19/44 600/38
2006/0289012 A1 * 12/2006 Reddy ..... A61H 19/34 128/844
2008/0027275 A1 * 1/2008 Topolev ..... A61H 19/34 600/38
2008/0009775 A1 10/2008 Murison
2010/0130816 A1 * 5/2010 Gekhter ..... A61F 5/41 600/39
2010/0305483 A1 * 12/2010 Werdt ..... A61H 23/00 601/46
2012/0123199 A1 * 5/2012 Topolev ..... A61H 19/44 600/38
2012/0271101 A1 * 10/2012 Tan ..... A61H 19/44 600/38
2013/0158446 A1 * 6/2013 Nan ..... A61H 23/0263 601/46
2013/0253264 A1 * 9/2013 Canbulat ..... A61H 19/32 600/38
2013/0253386 A1 * 9/2013 Nan ..... A61H 23/0263 601/46
2013/0261385 A1 10/2013 Zipper
2013/0296645 A1 * 11/2013 Evans ..... A61H 19/40 600/41
2014/0224263 A1 * 8/2014 Wilson ..... A61F 5/41 131/186
2014/0309565 A1 10/2014 Allen
2015/0157531 A1 * 6/2015 Sedic ..... A61H 19/32 601/46
2016/0166466 A1 * 6/2016 Topolev ..... A61H 19/44 601/46
2016/0279019 A1 * 9/2016 Callow ..... A61H 19/50
2016/0331629 A1 * 11/2016 Pearson ..... A61H 19/44
2017/0273861 A1 * 9/2017 Page ..... A61H 23/0254
2018/0028398 A1 * 2/2018 Ford, Sr. ..... A61F 5/41
2020/0368103 A1 * 11/2020 Rakshit ..... A61H 19/34

* cited by examiner

MASSAGE DEVICE COMPRISING A PRESSURE ELEMENT, METHOD FOR THE USE THEREOF, AND METHOD FOR THE MANUFACTURE THEREOF

CROSS-REFERENCE TO RELATED APPLICATIONS

This application is a National Stage entry of International Application No. PCT/RU2017/050062 filed on Jul. 27, 2017, which claims priority to Russian Patent Application No. 2016131026 filed on Jul. 28, 2016. the entire contents of which is hereby incorporated in its entirety by reference.

The invention pertains to a section of medical equipment, to devices for stimulating reflex points, massage, and can be used for massage by rubbing, pressure, vibration of separate parts of the body, including the genitals. The device for massage is used for personal massage, to meet sexual needs and can be used at home, and also in specialized institutions.

BACKGROUND

The prior art known device for massage and sexual stimulation of the genital organs "rabbit vibrator", comprising a main elongated member, adapted for vaginal stimulation and an additional elongated member, with a distal end adapted for clitoral stimulation and connected with its proximal end to the main member or its proximal end. The distal end of the additional member is directed in one side with the distal end of the main member and is small bent away from the main member. Wherein the additional member is much shorter than the main member, i.e. its distal end is shifted to the proximal end of the main member, so, the longitudinal distance between their distal ends is in average 10 cm. At this distance, the main member of the rabbit vibrator is inserted into the vagina up to the stop of the additional member in the head of the clitoris and the adjacent tissues (hereinafter the clitoris area), while the additional member is of small elastic mobility, and it is bent away from the main member during advancement of the main member deep into the vagina, on the average by 2 cm, displacing along the area of the clitoris by approximately the same distance. Thus, such devices are capable of reciprocating movements in the vagina (vaginal friction stimulation), without stimulation of clitoris or with short-term contact with clitoris area by distance of movement up to 10 cm, a with simultaneous clitoral stimulation with a constant contact with clitoris up to 2 cm, with what the length of the main member as a normal vibrator without clitoral stimulation, in average 15 cm. Therefore, the function performed by the devices can be attributed to a clitoral stimulation with a feeling of fullness in the vagina without frictional stimulation. The disadvantage of such devices is the limitation of the distance of movement in the vagina of the main member with simultaneous clitoral stimulation by the additional member, as well as the displacement of the additional member from the clitoris area at the simultaneous stimulation.

The prior art known device is a vibrator NOVA company We-Vibe, disclosed in the journal STOREROTICA Magazine, December 2015, p. 42. http://www.epageflip.net/i/609426-se-december-2015, which contains a vaginal stimulating member with a vibrator and a clitoral stimulating member with a vibrator, which is adapted of longitudinal angular resilient motion relative to its arc-shaped base. Wherein, the clitoral stimulation is provided not by the end of the clitoral member, but by its external longitudinal surface. According to the drawings, the end of the vaginal member longitudinally protrudes relative to the stimulating surface of the clitoral member by 5.2 cm, while the distance from the end of the vaginal member to the stimulating surface at maximum resilient angular displacement of the clitoral member to the arc-shaped base is 8 cm. Therefore, this device is able to simultaneously stimulate the clitoris and vagina during reciprocating movements to a distance within the range of 2.8 cm. In this case, an angular swinging movement is possible approximately about 60 degrees relative to the clitoral member, however, such movement are limited and provide a useful stroke in the vagina within 4 cm. Also, due to angular mobility of the clitoral member relative to its arched base, the clitoral member can perform small reciprocating movements along the clitoris within 1.5 cm. But if the head of the clitoris has a natural mobility per 1.5 cm, the friction is, that is, frictional stimulation does not occurs between the clitoris and the clitoral member, or it is negligible. The disadvantage of this device is the limited distance of movement of vaginal member in the vagina with simultaneous clitoral stimulation, as well as insignificant friction stimulation of the clitoris.

The prior art known device, the vibrator Opus Luxe, company NSNOVELTIES, disclosed in the journal STOREROTICA Magazine, December 2015, page 43. http://www.epageflip.net/i/609426-se-december-2015. Said device contains convex clitoral stimulator elastically connected with the vaginal member, which is formed by two elongated members connected by their first ends with formation of head part, and also connected by second ends, with formation of place for insertion of user's finger between elongated members. This design allows the use of clitoral stimulation with a little angular movement of the vaginal member, into which the user's finger is placed and helps to make deforming movements. The disadvantage of this device is the inability to produce significant vaginal stimulation at a distance of the length of the vagina with simultaneous clitoral stimulation.

The prior art known international application for invention PCT/RU2009/00055 publication WO/2010/044710 of Apr. 22, 2010. The first embodiment of the device comprises an elongated member with a front end and a rear end, suitable for insertion into a vagina and a stimulating member, suitable for stimulating an area of clitoris, made for movement along elongated element and spring-loaded from its rear end. This device provides a constant contact of the stimulating member with the area of clitoris during vaginal friction stimulation, while the reciprocating movements of the elongated member are possible on a considerable depth of the vagina, which is ensured by the distance of movement of the movable stimulating member, comparable with the length of the elongated member. The disadvantage of this device is that the movable member does not perform frictional movement significant for stimulation of the clitoris, and also complexity of construction, the presence of mechanically connected movable parts, which complicates operation and maintenance of device. Like it, the second embodiment of the device contains a vaginal member and a clitoral member, which is adapted of resilient displacement along the vaginal member and herewith performing reciprocating movements transversely to the vaginal member. The disadvantage of this device is that the clitoral member makes little reciprocating movements, about 2 cm, imparted to it by the wavy drive grooves of the vaginal member, and, in essential, are limited by its diameter. Moreover, due to the soft tissues of vaginal entrance, during operation of the device, there is no linear fixation of movements of vaginal member, and it can perform wave-like longitudinal movements relative to the clitoral member, which is fixed vice versa in the area of clitoris. Also the disadvantage of this device is the complexity of the construction, the presence of mechanically connected movable parts and an open internal structure, which complicates the operation and maintenance of the device.

The prior art known an industrial design EM002078162-0001 date of publication No. Jan. 8, 2012 (CA149467 Date of Registration 14 Nov. 2013, U.S. D694897 date of registration Mar. 12, 2013) is a vibrator of rounded shape with a longitudinal rounded recess, framed on both sides by arc-shaped wing-shaped elements curved inwards, with rounded ends smoothly turning into the recess. In this recess is placed a penis, which is enveloped by the wing-shaped elements and pressed against the zone of the vibrating member. The disadvantage of this device is the inability of simulating the coitus, that is, making them reciprocating motions along the penis, with preservation of the vibration zone on the penis head, which is the most sensitive erogenous zone responsible for the onset of orgasm.

The prior art known, an industrial design EM001171722-0001 is published date Nov. 5, 2009, which is an oblong-shaped vibrator at one end with a blind hole with an elastic cuff intended for inserting the penis into it, and a cylindrical vibratory block transversely located at the second end. The disadvantage of this device is the limited movement of the penis in the hole while maintaining the vibration zone on the penis head, since the vibration unit is rigidly connected to the body of the elastic cuff, and also a small distance of possible movement of the penis inside the cuff, which is considerably less than the average length of the erect penis. It is also widely known for male masturbators, which are elastic sleeves with a channel that simulates the vagina, including those located inside, in depth, along the channel one or several, vibrators. The disadvantage of such devices is the displacement of the vibration zones as the penis is inserted into the masturbator relative to the penis head, which means an intermittent vibration effect on the erogenous zone.

The following patent documents can be included in the prior art, defining the total level thereof: US2016/0051438; US2015/0359704; US2015/0231024; US2014/0194794; US2009/0318755; US2008/0119767; RU147082; RU2509548; RU2289385; RU2009115726; U.S. Pat. Nos. 9,254,238; 9,237,983; 9,192,254; 9,144,531; 9,119,765; 9,119,763; 9,114,056; 9,050,240; 9,028,395; 8,821,421; 8,419,611; 7,931,605; 7,749,178; 7,717,867; 7,658,707; 5,690,603; 5,853,362, U.S. D523,151; U.S. D523,152; U.S. D553,253; U.S. D605,779; U.S. D630,764; U.S. D636,887; U.S. D648,861; U.S. D652,946; U.S. D699,366; DM/087783; U.S. D666,304; U.S. D700,347; U.S. D700,350; U.S. D703,341; U.S. D706,442; DM/084346; U.S. D715,954; U.S. D719,274; U.S. D727,524; U.S. D727,525; U.S. D731,667; U.S. D738,520; EM001268429-0001; EM002774851-0001; CN201630027618.7; CN201630027901.X.

The closest prior art analogue, the prototype of the claimed device, is the device disclosed in the international application of PCT/RU2006/000121 publication WO/2006/110066 of 19 Oct. 2006. The device comprises a first elongate member having a first end and a second end and a second elongate member having a first end and a second end, which are connected to each other by their first ends, and their connection is made with the ability for insertion into the vagina. At that, the second elongated member is made flexible with the ability of stimulation of the clitoris area and ensures constant contact with the clitoris area in vaginal friction stimulation with a considerable distance of movement comparable with vaginal length. The disadvantage of this device is that, its operation is carried out by holding the second end of the first elongate member and imparting reciprocating motion by the first hand and while holding the second end of the second elongate member with tension and imparting back-and-forth reciprocating motion by the second hand, which is difficult to synchronize. The presence of the tensioning device connected to the second elongate member makes it possible to operate the device by one hand, but the same time this complicates the design of the device and creates the problem of fixing the tensioning device. In addition, linear stimulation, in which the flexible, essentially band-shaped member bends around the pubic bone, besides the clitoris area, also stimulates the adjacent areas of the genitals, which can distract and interfere with the focus on the sensations of clitoral stimulation.

The premise of the invention is the observation that the most sensitive erogenous zone of the female genitals is located in the region of the clitoris, and the most sensitive zones of internal genitals are located at the entrance to vagina, and may also be located in the middle part, known as "G-spot", and on vaginal vault in the area of the cervix. In males, the most sensitive erogenous zone is the penis head and the penis shaft closer to its base. Thus, two areas of human body on which said erogenous zones are located and necessary to reach orgasm, are spaced apart by distance approximately equal to penis length or vaginal depth.

For women, simultaneous stimulation of two erogenous zones is most effective to reach orgasm and the contact of the clitoral member with the clitoris area should occur immediately upon initial insertion of the vaginal member, and continue until full insertion into vagina of vaginal member. Moreover, the clitoris responsible for the achievement of orgasm is located at the distance from the entrance to the vagina and can move far away from it when excited. There are at least two kinds of stimulation: direct stimulation of the clitoris area and its head by friction with hand, tongue, penis, etc., or indirect stimulation of the clitoris through so-called "clitoral legs" located on both sides of vaginal entrance, on which the sexual impulses are transmitted during frictional stimulation of the vagina by the penis. According to research by experts, in most cases, achieving orgasm is possible using the first method. However, in some women, the clitoris is located close to the entrance to the vagina, so that there is a direct stimulation of the head of the clitoris occurs by friction the penis with simultaneous movement of the penis in the vagina, and they are able to experience stronger orgasmic sensations. Thus, the most effective sexual stimulation is reciprocating motion in the vagina of the elongated member and synchronous reciprocating motion of the stimulating member along the clitoris, in particular, on its head. It is known to those skilled in the art that the excited penis of a men has an average length of 15 cm, the length of the its head is 3-5 cm and is permanently located in the vagina during the frictional stage of the coitus, so that the penis is not drawn completely outwards. Consequently, the useful stroke of the penis in the vagina can be considered as the working stroke of the penis by 10-12 cm and namely such a length of movement (distance) should be the stroke of the vaginal member with simultaneous and continuous stimulation of the clitoris, which can be ensured by pressing the clitoral member to the clitoris by means of an resilient arcuate member, which is resiliently connected to vaginal member and made with the ability to be inserted into the vagina, or by itself as is vaginal member. This means that for effective stimulation of the clitoris, the stimulating surface of the clitoral member should have the length commensurate with the length of the vaginal member or the useful movement (stroke) of the vaginal member into the vagina. The use of a rectilinear member to stimulate the clitoris requires the presence of a free space to move it, and in the case of vaginal stimulation, this space occupies the vaginal member. Unlike vaginal stimulation, at which full contact between the vagina and vaginal member is necessary, the clitoris area has limited site, and the head of the clitoris, it can be said, has the point site and the spot of contact with the stimulating member has insignificant dimensions. Thus, the useful surface for the purpose of reducing the physical dimensions can be arranged in a curve, for example in an arc. Thus, when using a rounded stimulating member with a diameter of 2-3 cm, the required length of the stimulating surface of 10 cm is achieved by rotating the said member at 290-190 degrees. The increase in diameter reduces the necessary angle of rotation of the stimulating member. In this case, the curvilinear, substantially circular surface provides stimulation of a similar rectilinear surface, which has a compact size, which makes it possible to place the clitoral member in close proximity to the vaginal member so that their movements do not interfere with each other. In this case it is necessary to associate reciprocating movement of vaginal member and reciprocating rotational movement of clitoral member, so that the user would receive synchronous sexual impulses, as well as be able to control them predictably. The reciprocating rotational movement of the clitoral member is felt as a natural stimulation by the penis, and has the advantage that the convex surface provides more stimulation of the clitoris head than the surrounding tissues, due that the area of the contacting surface of the clitoral member is protrudes relative to the surrounding areas. In addition, in reciprocating rotational movement, lubricant is constantly in contact zone, and in the case of a unidirectional rotational movement it is gradually removed from the contact zone.

For a man, simultaneous stimulation of two erogenous zones is necessary to reach orgasm in most cases. Stimulation by friction or vibration of only the head of the penis without affecting the shaft of the penis may occasionally cause orgasm, but for completeness of sensations and complete sexual discharge, it is not sufficient, since there is no imitation of sexual intercourse, namely its copulatory stage with frictional stimulation of the penis by reciprocating its in the vagina. It is known to those skilled in the art that the excited penis of a men has an average length of 15 cm, the length of the its head is 3-5 cm and is permanently located in the vagina during the frictional stage of the coitus, so that the penis is not drawn completely outwards. Consequently, the useful stroke of the penis in the vagina can be considered as the working stroke of the penis by 10-12 cm. This means that for effective stimulation of the penis it is necessary to continuously act of its head and its base with two stimulating members, resiliently connected to each other, one of which is continuously pressed to penis head and the second one moves along its shaft from base to head by 10-12 cm. Making one stimulating member with the ability of reciprocating rotational movement on the head of the penis in the process of reciprocating movement of the second stimulating member through along the shaft of the penis enhances stimulating action and accelerates the achievement of an orgasm.

The object of the invention is to simplify operation by simplifying the design and expanding the technical functionality of device for massage of the genitals, adapted to act with the first body region (vagina or shaft of the penis) and the second body region (clitoris or penis head), resiliently connected to each other members, the first of which is adapted of its translational movement along the first body region, and the second one is adapted of its pressing to the second body region as far said translational movement proceeds by the distance approximately equal to the length of the vagina or penis and imitation of the frictional stage of the coitus in the vagina. The additional object of the invention is to increase the efficiency of the action of the second member on the second body region by the implementation of the device with the ability of rotational movement of the second member on the second body region in the progress of translational movement by the first member on the first body region.

The technical result of the invention is to simplify operation by simplifying the design and expanding the technical functionality of device for massage of the genitals, adapted to act with the first body region (vagina or shaft of the penis) and the second body region (clitoris or penis head), resiliently connected to each other members, the first of which is adapted of its translational movement along the first body region, and the second one is adapted of its pressing to the second body region as far said translational movement proceeds by the distance approximately equal to the length of the vagina or penis and imitation of the frictional stage of the coitus in the vagina. The additional technical result of the invention is to increase the efficiency of the action of the second member on the second body region by the implementation of the device with the ability of rotational movement of the second member on the second body region as far said translational movement proceeds by the first member on the first body region.

The above technical result is achieved by creating a device for massage with the following essential features: a device for massage of the genitals, comprising a first member and a second member; the first member is elongated with a first end and a second end; the first end of the first member is connected to the second member; the first member is made with an arc-shaped bend; the first member contains a first surface region is adapted to act with a first body region; the second member contains a second surface region is adapted to act with a second body region; said first surface region is elongated with an arc-shaped bend; said first surface region is adapted to translational movements along said first body region; the first member is adapted to resilient unbend in the progress of said translational movement and thereby give the first surface region a shape essentially said first body region; the first member is adapted to elastically press said second surface region to the second body region as far said translational movement proceeds.

The said essential features can be implemented in the device for massage of the genitals (hereinafter-device for massage) in which the first member is elongated with a rounded portion suitable for insertion into the vagina, or with a rounded longitudinal opening or recess for placing penis into it. The resilient of the first member is provided by a material of manufacture, for example, a silicone rubber having a hardness of 20-80 A Shore, preferably 40A Shore, or by the presence of a resilient member, such as a core made of metal or plastic. The first member is designed with a curvilinear bend, preferably arc-shape, and is connected to the second member. The second member has a movable connection including resilient with the first member, which provides its pressing against the clitoris or the head of the penis during the movement of the first member into the vagina or along the penis. The device can be designed as a universal means for use by women or men. In the first case, the second member is placed on the clitoris area and the first member is inserted into the vagina by its second end, it is given a rotational movement, by means of which its second end pushes into the vagina, the first member is unbent, and the second member is given rotation. In the second case, the second member is placed on the penis head and the first member moves along the penis to its base, wherein the first and second members located on opposite sides of the penis. When the second end of the first member advances towards to the penis base, its deformation occurs, it unbends and imparts rotation to the first member along the penis head. For convenience of use, the first surface area and the second surface area may be made with a flattening or recess for placing the penis. Also, the second member may have an indirect interaction on the penis head, for example by providing a second member with a vibrator, and the first member is made in the form of flexible sleeve with arc-shaped bend, the first end of which is adapted for insertion of the penis and the second end is resiliently connected to a vibratory device, for example a round shape. In this case, the sleeve envelopes the vibrator, which is pressed resiliently to it. This technical solution provides continuous stimulation of the penis and its head by friction, as well as provides a constant location of the vibration device on the head of the penis, which is pressed by the elasticity of the first member through its wall and transmits mechanical vibrations to the head of the penis, the constant location of the vibrator in the region of the head is provided by the elastic deformation of the sleeve, which expands upon insertion of the penis and the head pushes the vibrator in the direction of insertion.

Also, said essential features can be realized in a massage device in the presence of an additional member connected to the first member. The additional member has a length from 12 cm to 25 cm, preferably 18 cm, made straight or with a slight curvilinearity, for example, with a curved arc with a radius of 20 cm to 60 cm, preferably 40 cm, which has the property of rigidity or resilient sufficient for insertion into the vagina. The first member of the device for massage is made with a curvilinear arc-shaped bend away from the additional member, for example, along an arc with a radius from 2.5 cm to 6 cm, preferably 4.3 cm by an angle from 90 degrees to 270 degrees, preferably 125 degrees with the property of resilient necessary and sufficient for resilient bending along the additional member and restoring its original shape, and also with the necessary and sufficient pressing force of the second member to the clitoris area. The cross-section of the first and additional members is essentially part of circumference with a segment from 150 degrees to 270 degrees, preferably 180 degrees, with rounded corners, a height of from 0.5 cm to 4.5 cm, preferably 1.5 cm, with a width of from 1 cm to 9 cm, preferably 3 cm. Wherein It is preferred that their cross-sections form an essentially whole circle, since parts of the circumference form the outer surfaces of said members and are thus able to mimic the shape of the penis. In addition, increasing the thickness of the second member makes it possible to manufacture it from a material with a lower rigidity of about 40A shore, without an inner elastic core, which is desirable in the monolithic construction of the massage part of the device. And also, approximately half the thickness of the first member from the total thickness of the first member with the additional member, allows to optimal ratio between longitudinal displacement of stimulating member and its lateral displacement. The second end of the first member is connected to the first end of the additional member by essentially end connection. Wherein, the longitudinal axis of the additional member lies approximately in the plane of bending of the second member. Said connection forms a convex rounded shape, which is essentially the distal end of the device for massage (front end, head part). It can be made of a body of rotation, for example, in the form of an ellipsoid with the first diameter from 2 cm to 6 cm, preferably 3.5 cm, and a second diameter from 3 cm to 9 cm, preferably 6 cm, and comprises at least one electro-mechanical means for creating mechanical vibrations (hereinafter—vibrator) and the device comprises power supply source and control means. Additionally, the said connection can be made with a protrusion to stimulate the "G"-spot. The second member functions as a clitoral stimulator and is made with a convex, substantially rounded, surface. The connection of the stimulating member and the first end of the first member can be made with a movable connection providing angular or axial movement, including resilient, in order to ensure its pressing against the external area of the clitoris in the process of insertion of the connection of the ends of the elongated members in the vagina. In some embodiments, the stimulation member may be made as an extension of the first member, in which case it is determined from the starting point, which is suitable for contact with the clitoris region in the initial insertion, performing its function. The initial point of the surface suitable for stimulation of the clitoris is located near the connections of the elongated members with a slight longitudinal displacement, so that when the said connection is initially inserted into the vagina, the said point is brought into contact with the clitoris region. If the perpendicular from said point to the longitudinal axis of the joint of the elongated members is lowered, which approximately coincides with the axis of the vagina or the axis of insertion, the distance from the tip of the distal end of the massage device to the point of intersection with the normal will be from 0 cm to 9 cm, preferably 3.5 cm, and the distance from this point to the intersection of the perpendicular with the surface of the connection of the elongated members will be from 2 cm to 5 cm, preferably 3.5 cm, which is actually the distance between the clitoris and the vagina. From said initial point, in plane of bending of first member, stimulating surface is formed along circle with radius from 1.5 cm to 4.5 cm, preferably 2.5 cm, along an arc of 90 degrees. Up to 330 degrees, preferably 240 degrees, in this case, the centre of the arc faces in the direction close to the substantially perpendicular to the second end of the first member, or deviates from perpendicular in longitudinal plane by not more than 45 degrees, the second member may be smoothly connected to the first end of the first member so as to be integral therewith, so that the first end of the first member performs the function of a stimulating member. The radius of the arc of the second member is less than the radius of the arc of the first member, and they may form a spiral shape, for example by means of connection to each other by another arc having average arithmetic radius of arc of the first member and radius of arc of the second member. In addition, the overall shape of said members may be an arbitrary spiral, or archimedes Spiral, or a truss coil, or a combination thereof. The shape of the second member can be made of a body of revolution, for example, in the form of a ball, the first member envelopes the stimulating member, including the non-convex angle. Since the additional member is rigid and the first member is resilient, their properties can be provided by monolithic manufacture of elongated members from resiliently deformable material, for example, a silicone rubber having a Shore a hardness of from 5 to 80, preferably, 40, the second member may comprise a rigid core or an inner body, and the additional member can also have a core made of a resilient material or not have it. The described design allows the second member to be displaced by a distance of up to 20 cm, preferably 15 cm, and the device for massage reciprocates in the vagina by approximately the same distance. This is achieved due to the arcuate bend of the first member, which resiliently unbends along the additional member. Essentially, the arc of the first member rolls out along the additional member and acquires the linearity of the additional member, thereby imparting to both of the members a shape imitating the erect penis. In this case, the second member makes a turn in the plane of bending of the first member, the axis of rotation of the second member remains approximately at one distance from the axis of insertion, as a result of which the second member remains in the area of contact with the clitoris region during the whole length of insertion and removal of the device. In this case, the second member makes a turn in the plane of bending of the first member, the axis of rotation of the second member remains approximately at one distance from the axis of insertion, as a result of which the second member remains in the area of contact with the clitoris region during the whole length of push in and pull out of the device. Besides, the second end of the first member can be arranged with the ability of installation on a smooth surface, for which it is equipped, for example, with a suction cup, or with the ability of being connected to the human body, for which it is provided, for example, with a shape providing a connection with a belt (harness) or with a shape suitable for insertion into the vagina of another user, or with the ability of being connected to a mechanical device (sex machine), for which is provided, for example, with a profile lock-adapter (vacuum lock). At the beginning of insertion, the second member rests against its starting point of surface in the clitoris region, and by means of the connection to the first member, pushes the first member, which under the action of force unbends along the additional member. The length of the arc of the first member is reduced and the first member pulls the second member behind it, which results in its rotation relative to the axis of the arc of the surface, commensurate with the length of the arc, and also presses it to itself. Essentially, at the second member shifts the attachment point along the insertion axis, and thus the point of contact of the stimulating surface with the clitoris has approximately the same distance from the axis of insertion throughout the entire displacement distance of the stimulating member. This gives an advantage over a fixed point of attachment that is only possible with shift to the proximal end, which implies an elongation of the stimulating member, an increase in the radius of the arc and its removal from the axis of insertion at deformation. When the distance of insertion in the vagina is reached, the additional member is given an inverse linear movement, and under the action of the resilient forces the first member returns to the initial position and presses the second member against the clitoris region. Since the frictional stage does not assume complete removal of the massage device from the vagina, the stimulating member does not lose contact with the clitoris region. Further, the cycle of reciprocating movement of the device for massage is repeated, and thus the second member is given a reciprocating-rotational movement. In other words, it can be said that the shape of the massage device is a dildo with longitudinal separation into two parts from the rear end to the head, one of which is curved perpendicularly to the plane of incision of the dildo so that its rear end is close to the head. In this case, curved part is made flexible and, so that under external action it is bent along straight part, assumes its shape and they both form the shape of a dildo. The straight part has a rigidity ensuring insertion of the head in the vagina and movement of both parts in the vagina. The rear end of the curved part is joined to the stimulating member made with an arc-shaped curvature of the surface along the plane of bending of this part.

Additionally, the device may comprise all of the components known in the prior art, inherent in a modern massage device with a similar purpose. In order to enhance the massage and stimulating effect, the massage device may contain at least one vibrator, which is arranged to impart a rotational movement to the vibration-generating mass, for which, for example, comprises an electric motor with an eccentric mass mounted on the output shaft thereof, or to impart a reciprocating motion to the vibration-generating mass, for example, it comprises a coil element with a movable ferromagnetic core. The vibrator can be installed into the stimulating member, into the zone of connection of the first member and the second member, into the first member, into the second member, into the handle of the massage device, single or serially and can be made both built-in and removable. Additionally the device for massage can be made with the ability of heating its surface, with video camera, with microphone, with a light or sound control means capable of controlling over a radio channel (Bluetooth), with the aibility of communication and transmission of data with smart phone and internet network, with the ability of setting and storing modes of operation, with the ability of electric stimulation, with the ability of vacuum stimulation. The device, or its parts, may be made of materials suitable for contact with the skin and mucous membranes, both monolithic and assembled, as well as waterproof, with a simple shape consisting of primitive geometric figures, anatomically simulating body parts, or combinations thereof. The surface of the device for massage can be smoothed, or with a developed relief structure, which contains protrusions and/or recesses, matte, glossy or with their combination, closed. In order to provide power, the massager is supplied with a removable (replaceable) or built-in rechargeable power source (hereinafter—battery), for example, a lithium-ion power source, which is electrically connected to the control means, the vibrator and other components of the device. The battery can be charged by connecting to an external power source through the built-in in the device for massage connector with a USB cable, through external electrical contacts or electrically conductive surface areas, and can also be charged in a contactless manner by induction, and have a stand with the function of a charger.

The task of the method of application is simplification of operation due to simplification of the design and expansion of technical functionality with usage of device for massage, which is capable of performing a reciprocating rotational movement, including a non-convex angle, with pressing in the region of the clitoris by a rounded member, which is transmitted to it by an elongated member while simultaneously performing the reciprocating motion and simulating the frictional stage of the coitus in the vagina in such a manner, the distance of movement of the elongated member corresponds approximately to the length of the vagina, and the length of the arc described by the stimulating surface of the rounded member corresponds approximately to this distance. At that stimulation of clitoris should start in the position of initial insertion of vaginal member in vagina, is continued until it is inserted over the whole length of the vagina and in the return movement of the vaginal member to the position of initial insertion, where the stimulating cycle is completed.

The technical result of the method of application is simplification of operation due to simplification of the design and expansion of technical functionality with usage of device for massage, which is capable of performing a reciprocating rotational movement, including a non-convex angle, with pressing in the region of the clitoris by a rounded member, which is transmitted to it by an elongated member while simultaneously performing the reciprocating motion and simulating the frictional stage of the coitus in the vagina in such a manner, the distance of movement of the elongated member corresponds approximately to the length of the vagina, and the length of the arc described by the stimulating surface of the rounded member corresponds approximately to this distance.

The above technical result is achieved by using a device for massage with the following essential features: A massage method, characterised in that: simultaneously affecting a vagina and a clitoris, using a device for massage of the genitals, comprising: a first elongated member with a first end and a second end; a second elongated member with a first end and a second end; the first end of the first elongated member is connected to the first end of the second elongated member; the connection of the first elongated member and the second elongated member is adapted to be inserted into a vagina; producing reciprocating movements of the first elongated member and the second elongated member; for which the second elongated member is made with a curvilinear bend; the second elongated member is adapted to resilient unbend essentially along the first elongated member and to impart capable of joint insertion into the vagina of the first elongated member and the second elongated member simultaneously; the second elongated member contains a stimulating member, made with the capability of stimulating a clitoris area; the stimulating member is adapted to resilient displacement essentially along the first elongated member; the stimulating member comprises of convex, essentially in the plane of the second elongated member, a curvilinear stimulating surface; the stimulating member is placed in the clitoris area, and the reciprocating rotational movement of the stimulating surface in the clitoris area is performed during the reciprocating movement of the first elongated member and the second elongated member into the vagina. Additionally the method of massage is characterized in that the device for massage of the genitals and/or a vagina and a clitoris region is covered with a lubricant, gives to the device for massage movements by a hand, holding the second end of the first stimulating member, or connecting it to a body of a user or a partner or with a mechanical device.

The task of the method for manufacture is to obtain a massage device with a simplified construction and, as a result, simplified operation, as well as expansion of technical functionalities, which is adapted of performing a reciprocating rotation, including a non-convex angle, with a pressing in a clitoris region by a rounded member, which is transferred to it by an elongated member while simultaneously performing the reciprocating movement and imitating the frictional stage of coitus in the vagina in such a way that the distance of movement of the elongated member corresponds approximately to the length of the vagina, and the length of the arc described by the stimulating surface of the rounded member corresponds approximately to this distance. In this case, the massage device should have a simple structure without mechanical hinge joints due to the resilient connection between the vaginal member and the clitoral member, which simplifies its operation and maintenance.

The technical result of the method for manufacture is to obtain a massage device with a simplified construction and, as a result, simplified operation, as well as expansion of technical functionalities, which is adapted of performing a reciprocating rotation, including a non-convex angle, with a pressing in a clitoris region by a rounded member, which is transferred to it by an elongated member while simultaneously performing the reciprocating movement and imitating the frictional stage of coitus in the vagina in such a way that the distance of movement of the elongated member corresponds approximately to the length of the vagina, and the length of the arc described by the stimulating surface of the rounded member corresponds approximately to this distance.

The above technical result is achieved by manufacturing a device for massage with the following essential features: A method of manufacturing a device for massage of the genitals, characterized in that: manufacturing the device for massage of genitals, comprising: a first elongated member with a first end and a second end; a second elongated member with a first end and a second end; the first end of the first elongated member is connected to the first end of the second elongated member; the connection of the first elongated member and the second elongated member is adapted with for insertion into a vagina; the second elongated member is made with a curvilinear bend; the second elongated member is adapted to resilient unbend essentially along the first elongated member and impart the capability for joint insertion of the first elongated member and the second elongated member into the vagina; the second elongated member is made with a stimulating member is adapted for stimulating a clitoris area; the stimulating member is adapted for resiliently displacement essentially along the first elongated member; the stimulating member is made with a convex, essentially in the plane of the second elongated member, a curvilinear stimulating surface. Additionally the method of manufacturing of a device for massage is characterized in that the members of the device for massage are made integrally from silicone rubber with a hardness from 5 units, up to 80 units, preferably 40 units Shore A, by hot vulcanization in a mould, then the first elongated member is provided with a rigid core, an electromechanical device for generating mechanical vibrations is installed in the connection zone of the first elongated member and the second elongated member, an electromechanical device for generating mechanical vibrations is installed in the stimulating member and power supply members and control units to the second end of the first elongated member, or these said components are earlier placed in a mould, after which it is filled with silicone rubber and vulcanized using elevated temperature and pressure.

DETAILED DESCRIPTION

Figure 1:
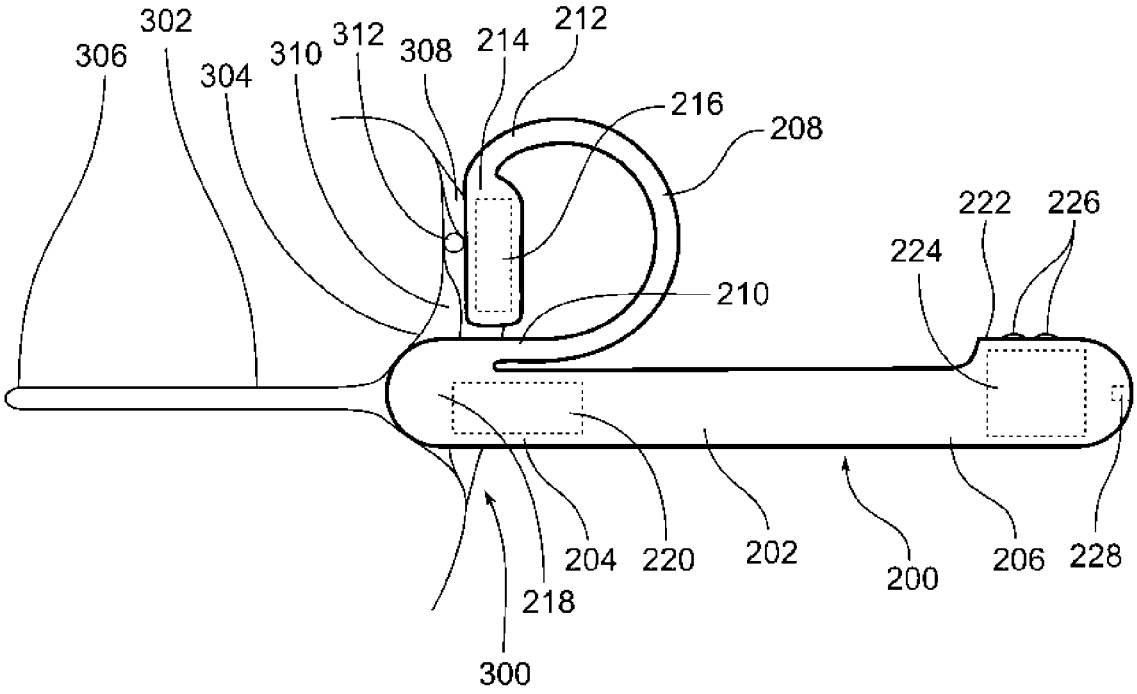
FIG. 1 is a side view of a device for massage, according to the first modification, in an initial insertion stage into a vagina.
Figure 2:
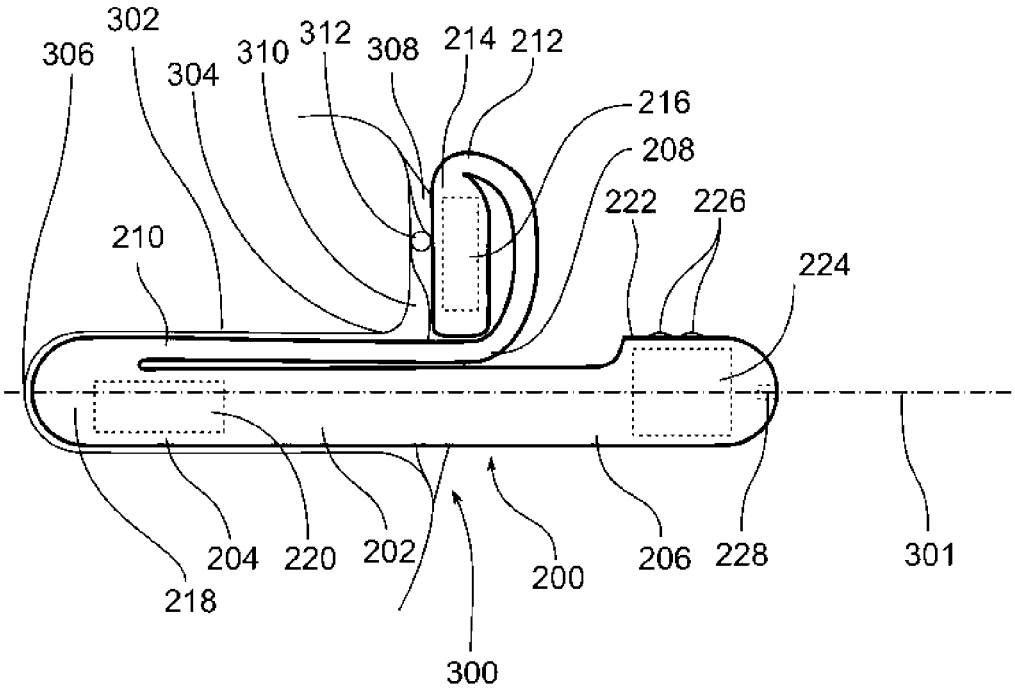
FIG. 2 is a side view of the device for massage, according to the first modification, in a final insertion stage into the vagina.

The implementation of the invention on the example of the first modification of the device. FIG. 1 shows the device for massage 200 with the first elongate member 202, which is rectilinear, with its first end 204 and the second end 206. The second elongated member 208, made with a curvilinear bend in an arc, with a first end 210 and a second end 212 transits to a stimulation member 214 comprising a vibrator 216. The connection of the first member and the second member forms a convex rounded distal end of the device 218, inside which the vibrator 220 is located. The second end of the first member 206 transits to the handle 222 in which the power supply and control unit 224 is located, with the on/speed control buttons and modes 226. In the back of the device is a connector for the charger 228. In the initial stage of insertion, the device for massage 200 is positioned in the genital area of the woman 300 in the direction of the vagina 302 and inserted into the entrance in the vagina 304 towards the posterior fornix 306. When the stimulating member 214 is located in the region of the clitoris 308 along the labia 310 and rests on the head of the clitoris 312. FIG. 2 shows the same device for massage 200 in the final stage of insertion, in which the connection of the members 218 advances along the insertion axis 301 in the vagina 302 by pushing the first member 202 while holding the device 200 by the handle 222 of the user's hand or partner. Under the influence of the external force, the stimulation member 214 rests to the clitoris region 308 and contacts the head of the clitoris 312, while resiliently pushing the second member 208, which is resiliently unbent along the first member 202 and, approaching which, forms with it a shape, essentially a dildo, suitable for insertion and movement in the vagina. The arc that the second member forms is deformed as the device moves, while the stimulating member 214 makes an resilient angular movement relative to the second member 208 which resiliently presses it to the area of the clitoris 308 thereby ensuring continuous contact. The user determines the desired insertion depth of the device 200, thereby affecting the amplitude of the reciprocating movements. When the connection of the ends 218 reaches the vaginal fornix 306, the user gives the device the reverse movement, in which the resilient of the second member 208, returning to its initial position, provides downforce with the stimulating member 214 to the area of the clitoris 308. Additionally, the user is available for vibration functions, both in the vagina and in the clitoris region, and their speed, operation modes, and combination are selected by pressing the buttons 226.

Figure 3:
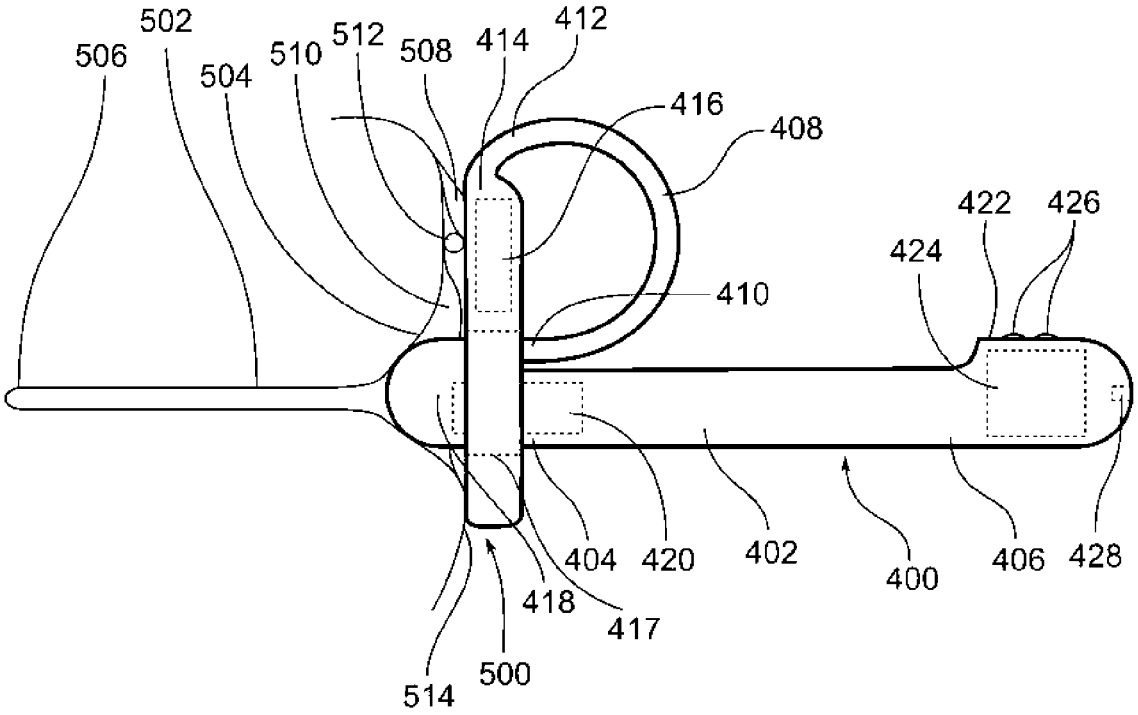
FIG. 3 is a side view of a device for massage, according to the second modification, in an initial insertion stage into a vagina.
Figure 4:
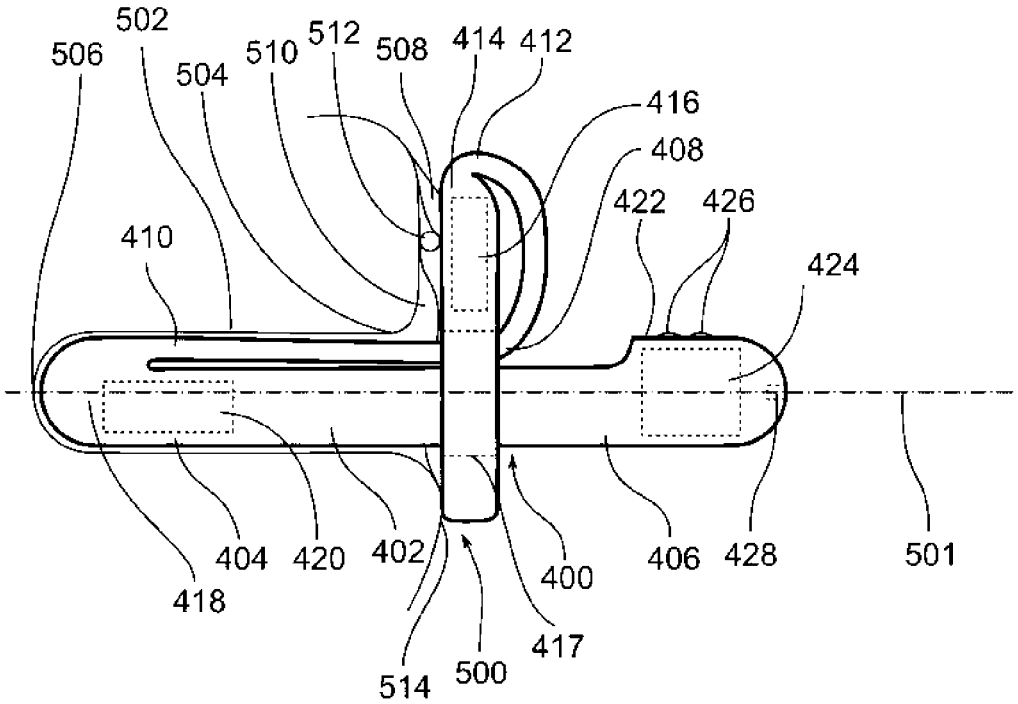
FIG. 4 is a side view of the device for massage, according to the second modification, in a final insertion stage into the vagina.

The implementation of the invention on the example of the second modification of the device. FIG. 3 shows the device for massage 400 with the first elongate member 402, which is rectilinear, with its first end 404 and the second end 406. The second elongated member 408 is made with a curvilinear bend in arc, with the first end 410 and the second end 412 passing into the stimulating member 414, comprising a vibrator 416 and a through hole 417 with a first member and a second member inserted therein 418, which forms a convex rounded distal end of the device inside which the vibrator 420 is located. The second end of the first member 406 enters a handle 422 in which a power supply and control unit 424 is disposed, with on/speed control buttons and modes 426. In the back of the device is a connector for the charger 428. In the initial stage of insertion, the massager 400 is located in the genital area of the woman 500 in the direction of the vagina 502 and inserted into the entrance of the vagina 504 in the direction of the posterior fornix 506. When the stimulating member 414 is disposed in the region of the clitoris 508 along the labia 510 and rests against the head of the clitoris 512 and the perineum 514. FIG. 4 shows the same device 400 in the final stage of insertion, wherein the connection of the members 418 is advanced along the insertion axis 501 in the vagina 502 by pushing the first member 402 while holding the device 400 by the handle 422 with the hand of a user or partner. Under the influence of an external force, the stimulating member 414 rests against the area of the clitoris 508 and contacts the head of the clitoris 512, while it resiliently pushes the second member 408, which elastically unbends along the first member 402 and, approaching which, forms a shape with it, suitable for insertion and movement in the vagina. The arc which forms the second member deforms as the device moves, in this case, the stimulating member 414 performs a resilient angular movement relative to the second member 408 which resiliently presses it against the region of the clitoris 508, thereby providing a continuous contact. The user determines the required insertion depth of the device 400, thereby influencing the amplitude of the reciprocating movements. When the connection of the ends 418 reaches the vaginal fornix 506, the user provides the device the reverse movement, in which the resilient of the second member 408 returning to its original position, provides the downforce by the stimulating member 414 to the area of the clitoris 508 and perineum 514. Additionally, the user is available for vibration functions, both in the vagina and in the clitoris region, and their speed, operation modes and combination are selected by pressing the buttons 426.

Figure 5:
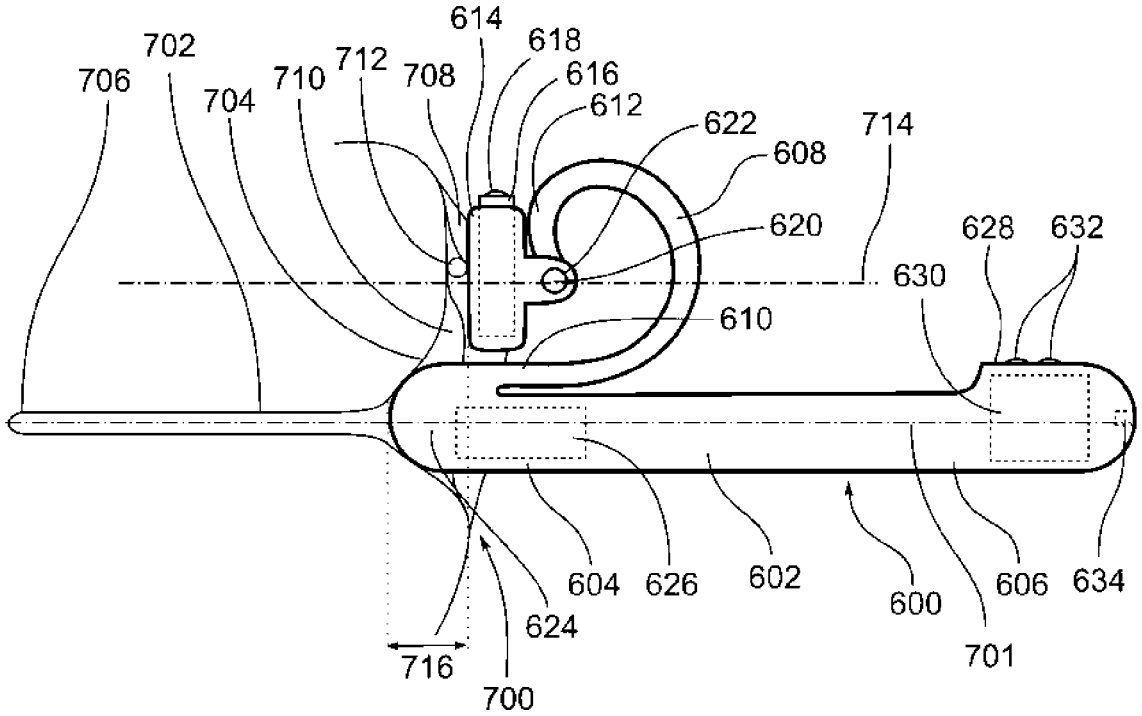
FIG. 5 is a side view of a device for massage, according to the third modification, in an initial insertion stage into a vagina.
Figure 6:
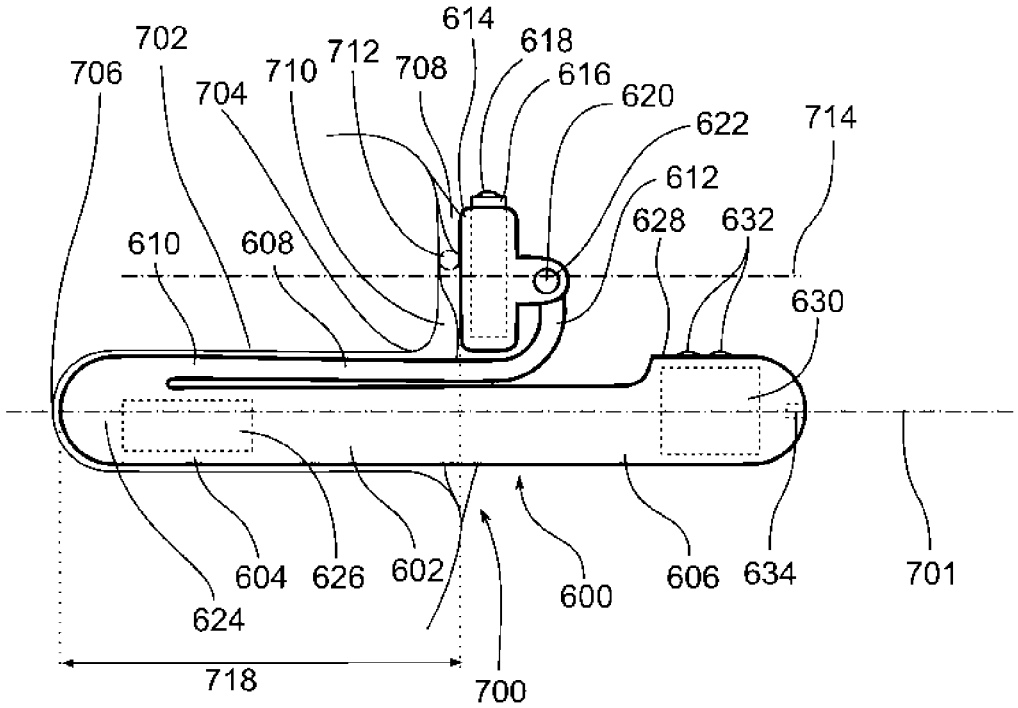
FIG. 6 is a side view of the device for massage, according to the third modification, in a final insertion stage into the vagina.

The implementation of the invention on the example of the third modification of the device. FIG. 5 shows the device for massage 600 with the first elongate member 602, which is rectilinear, with its first end 604 and the second end 606. Second elongated member 608 is made with curvilinear bend in a spiral, with a first end 610 and a second end 612 movably connected to the stimulation member 614, comprising an attachable vibrator 616 with a control button 618, for which the second end of the second member comprises an axis 620 to which the stimulation member 614 is mounted by means of an opening 622. The connection of the first member and the second member 624 forms a convex rounded distal end of the device inside which the vibrator 626 is located. The second end of the first member 606 enters a handle 628 in which a power supply and control unit 630 is disposed, with start/speed control buttons and modes 632. At the rear of the device there is a connector for connecting the charging device 634. In the initial stage of insertion, the massager 600 is positioned in the area of the genitals of the female 700 along the axis of insertion 701 in the direction of the vagina 702 and inserted into the entrance in the vagina 704 towards the posterior arch 706. When this stimulating member 614 is located in the area of the clitoris 708 longitudinally to the labia 710 and rests on the head of the clitoris 712. The axis of insertion 701 and the axis of movement 714 are schematically shown, and the same initial distance 716 between the starting point of the stimulating surface and the most distant connection point 624. FIG. 6 shows the same device for massage 600 in the final stage of insertion in which the connection of the members 624 is moves forward along the insertion axis 701 in the vagina 702 by pushing the first member 602 when the device 600 is held behind the handle 628 by the user's hand or partner. Under the influence of the external force, the stimulating member 614 rests the region of the clitoris 708 and contacts the head of the clitoris 712, and resiliently pushes the second member 608, which is resiliently straightening along the first member 602 and closer to which forms the shape thereof, essentially dildo suitable for insertion and movement in vagina. The spiral that forms the second member 608 deforms as the device moves, while the stimulating member 614 rotates about the axis 620 with respect to the second member 408, which resiliently presses it against the region of the clitoris 708, thereby providing continuous contact. By reducing the length of the spiral and turning its axis, the axis of rotation of the stimulating member 614 is displaced along the axis of movement 714 substantially parallel to the axis of insertion 701 and synchronously with it at the same insertion distance. During the complete insertion of the connection ends 624, the stimulating member 614 performs a linear movement along the axis of movement 714 with a slight displacement relative to the axis of insertion 701. In this case, the useful insertion distance, at which simultaneous friction of the vagina and clitoris occurs, is the difference between the initial distance 716 (FIG. 5) and the final distance 718. The user determines the necessary depth of insertion of the device 600, which influencing the amplitude of the rotational reciprocating movements. When the connection of the ends 624 to reach the vaginal vault 706, the user provides back motion the device, in which the resilient of the second member 608, returning to the initial position provides downforce for stimulating member 614 to the area of the clitoris 708 and the clitoris head 712. Additionally, vibration functions are available to the user, both in the vagina and in the area of the clitoris, and their speed, modes of operation, and combination are selected by pressing the 618 and 632 buttons.

Figure 7:
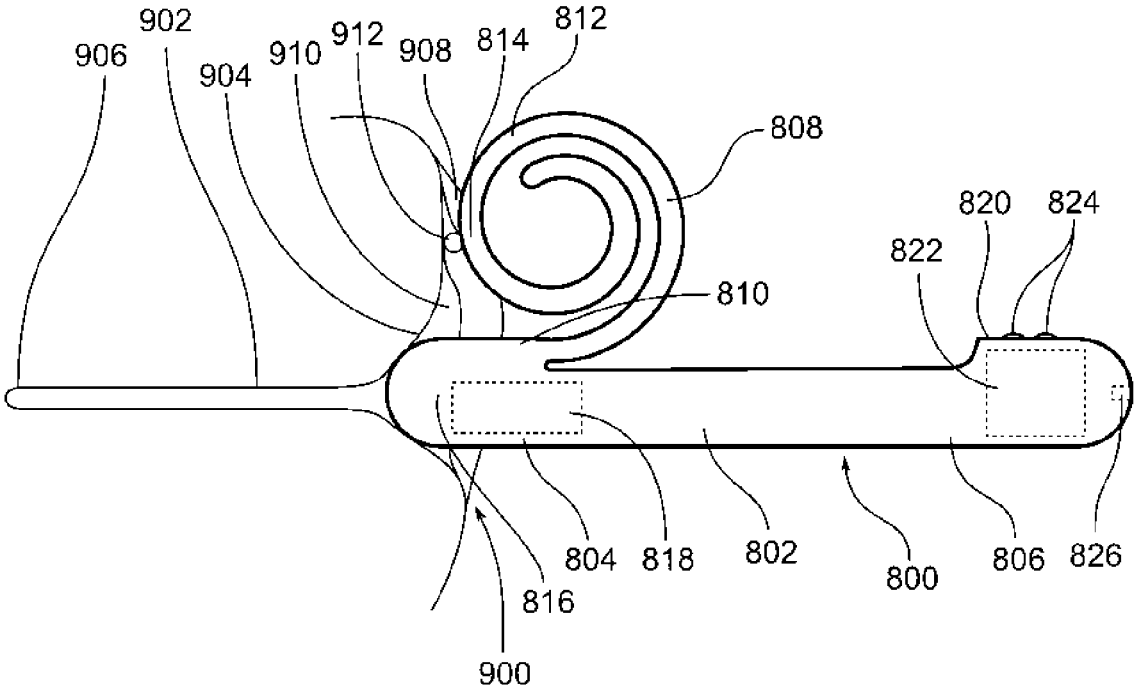
FIG. 7 is a side view of a device for massage, according to the fourth modification, in an initial insertion stage into a vagina.
Figure 8:
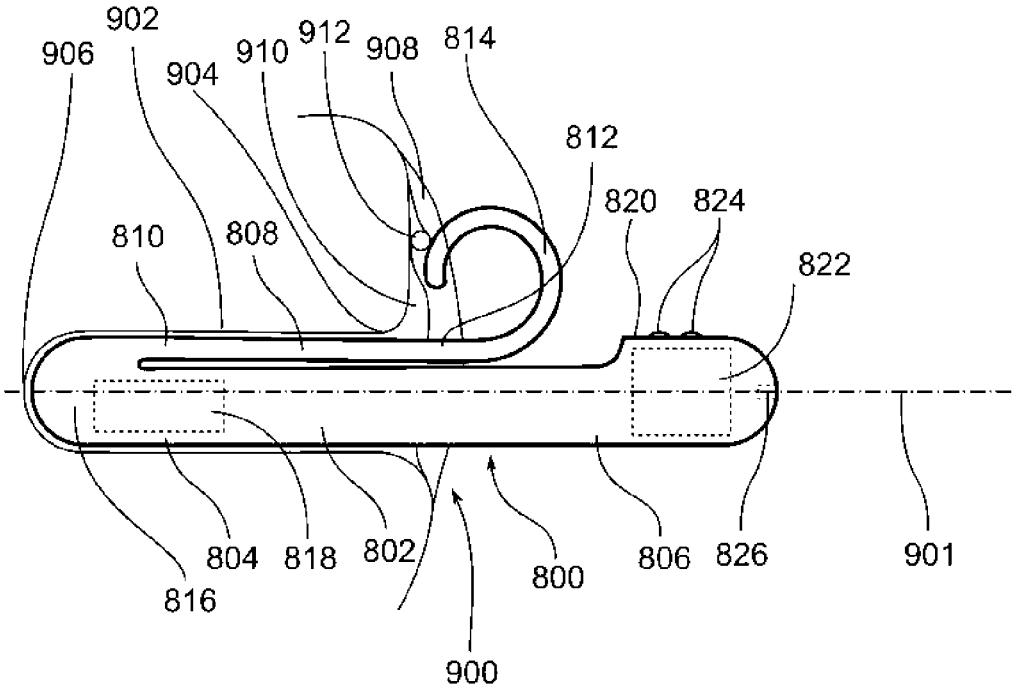
FIG. 8 is a side view of the device for massage, according to the fourth modification, in a final insertion stage into the vagina.

The implementation of the invention on the example of the fourth modification of the device. FIG. 7 shows the device for massage 800 with the first elongate member 802, with its first end 804 and the second end 806. The second elongate member 808, which is curved in a spiral manner, with a first end 810 and a second end 812, smoothly turning into the stimulating member 814, which is made integral with it a whole. The connection of the first member and the second member forms a convex rounded front end of the device 816, inside which the vibrator 818 is located. The second end of the first member 806 passes into a handle 820 in which a power supply and control unit 822 is disposed, with the on/speed control buttons and modes 824. At the rear end of the device there is a connector 826 for connecting the charging device. In the initial stage of insertion, the massager 800 is positioned in the area of the genitals of the woman 900 in the direction of the vagina 902 and inserted into the entrance in the vagina 904 towards its arch 906. When the stimulating member 814 is located in the area of the clitoris 908 longitudinally to the labia 910 and rests against the head of the clitoris 912. FIG. 8 shows the same device for massage in the final stage of insertion, in which the front end of the device 816 proceeds forward along the insertion axis 901 in the vagina 902 by pushing the first member 802 while holding the device 800 by the handle 820 with the hand of a user or partner. Thus, the stimulation member 814 rests the clitoris region 908 and the head of the clitoris 912 and resiliently pushes the second member 808, which is resiliently unbent along the first member 802 and, which together with it forms the shape of a substantially phallosimulator suitable for insertion and movement in the vagina. The spiral, which is formed by both the second member and the stimulating member, as the device moves, the facing to the clitoris area 908 convex rounded stimulating surface of the stimulating member 814 spins around the head of the clitoris 912, making continuous contact. The user determines the desired insertion depth of the device 800, while affecting the amplitude of the rotational reciprocating movements of the stimulating member 814. When the front end of the device 816 reaches vaginal vault 906, the user gives the device the reverse movement, in which the resilient of the second member 808 imparts a rotation in the opposite direction to the stimulating member 814 and returns it to the original position, in doing so, provides a pressure force to the stimulating member 814 to the region of the clitoris 908 and to the clitoris 912. Additionally, the user has access to vibration functions in the vagina, and the speed and modes of operation are selected by pressing the 824 buttons.

Figure 9:
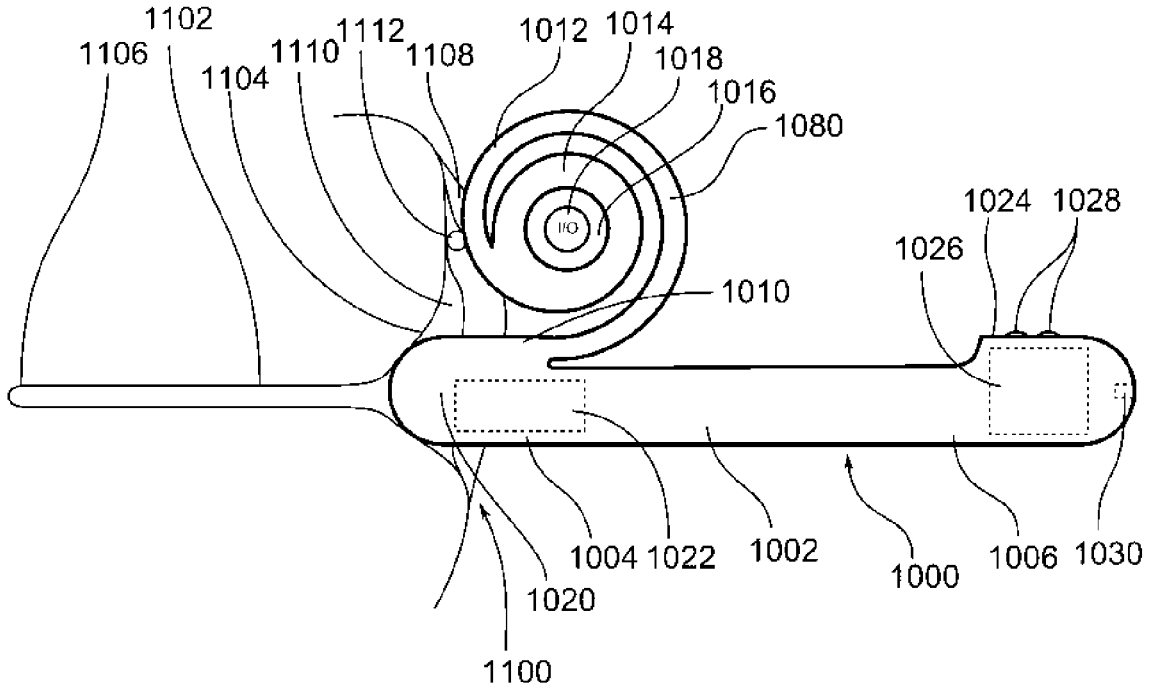
FIG. 9 is a side view of a device for massage, according to the fifth modification, in an initial insertion stage into a vagina.
Figure 10:
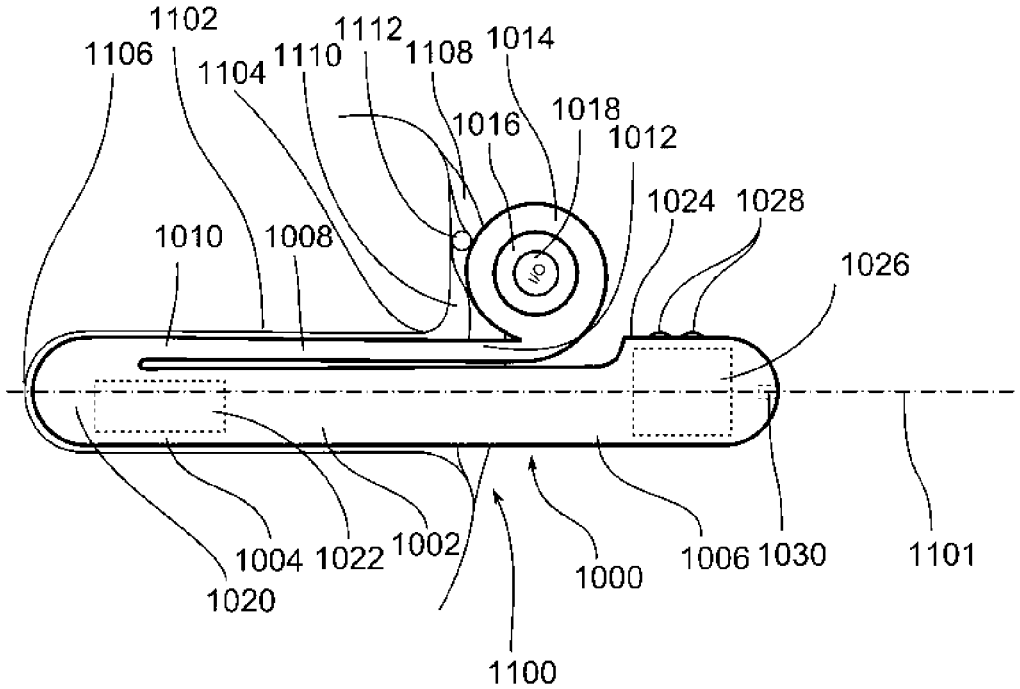
FIG. 10 is a side view of the device for massage, according to the fifth modification, in a final insertion stage into the vagina.

The implementation of the invention on the example of the fifth modification of the device. FIG. 9 shows the device for massage 1000 with the first elongate member 1002, with its first end 1004 and the second end 1006. The second elongated member 1008, made with a curved bend in an arc, with the first end 1010 and the second end 1012, smoothly turning into a stimulating member 1014 made in the form of a body of revolution, with a transversely mounted removable vibrator 1016, with a power button 1018. The connection of the first member and the second member forms a convex rounded front end of the device 1020, inside which the vibrator 1022 is located. The second end of the first member 1006 enters the handle 1024, in which the power supply and control unit 1026 is located, with the on/speed control buttons and modes 1028. At the rear end of the device there is a connector 1030 for connecting the charging device. In the initial stage of insertion, the device for massage 1000 is positioned in the area of the genitals of the woman 1100 in the direction of the vagina 1102 and inserted into the entrance in the vagina 1104 towards its fornix 1106. Thus the stimulating member 1014 is located in the area of the clitoris 1108 longitudinally to the labia 1110 and rests against the head of the clitoris 1112. FIG. 10 shows the same device for massage in the final stage of insertion, in which the connection of the members 1020 progress moves forward along the insertion axis 1101 in the vagina 1102 by pushing the first member 1002 while holding the device 1000 by the handle 1024 with the hand of a user or partner. Thus, the stimulation member 1014 rests the clitoris region 1108 and the head of the clitoris 1112 and resiliently pushes the second member 1008, which is resiliently unbent along the first member 1002 and, which together with it forms the shape of an essentially dildo suitable for insertion and movement in the vagina. As the device is moved, the arc of the second member 1008 is unwound and turned towards the clitoris region 1108 the convex rounded stimulating surface of the stimulating member 1014 rotates on the head of the clitoris 1112, making continuous contact. The user determines the necessary depth of insertion of the device 1000, which affects the amplitude of the rotational reciprocating movements of the stimulating member 1014. When the connection of the ends 1020 reaches the vaginal fornix 1106, the user gives the device the reverse movement, in which the resilient of the second member 1008 imparts a rotation in the return direction to the stimulating member 1014 and returns it to its initial position, in doing so, provides a pressure force to the stimulation member 1014 to the clitoris region 1108 and to the clitoris 1112. Additionally, the user has access to vibration functions both in the vagina and in the clitoris region, and the speed and modes of operation are selected by pressing the 1028 and 1018 buttons.

Figure 11:
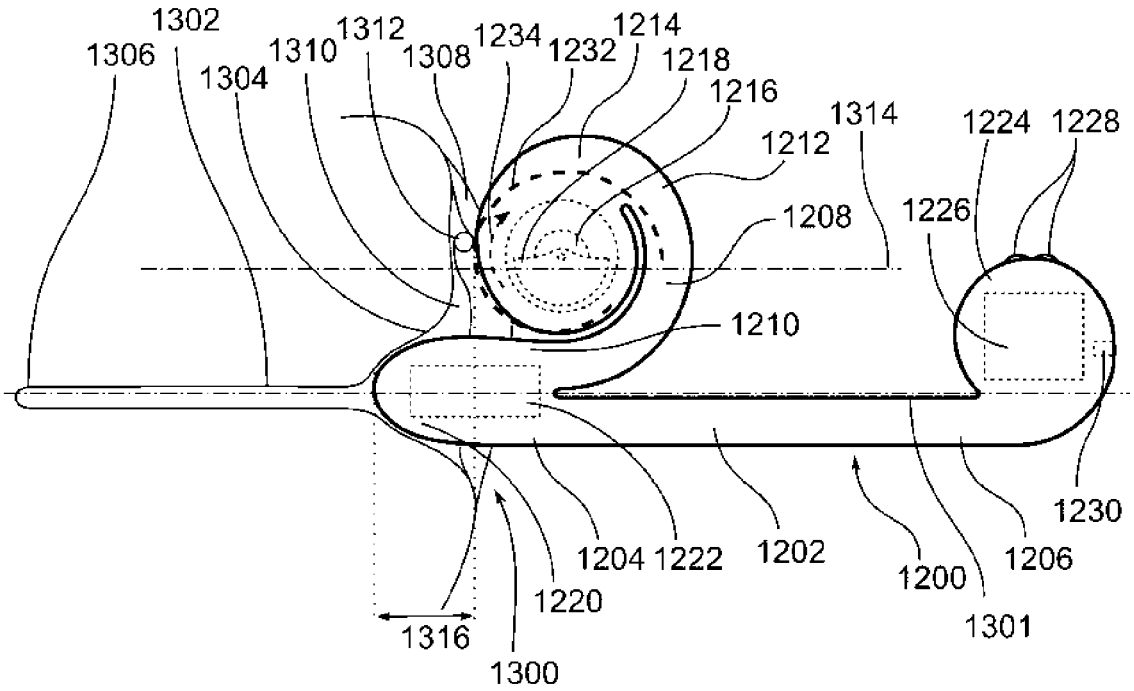
FIG. 11 is a side view of a device for massage, according to the sixth modification, in an initial insertion stage into a vagina.
Figure 12:
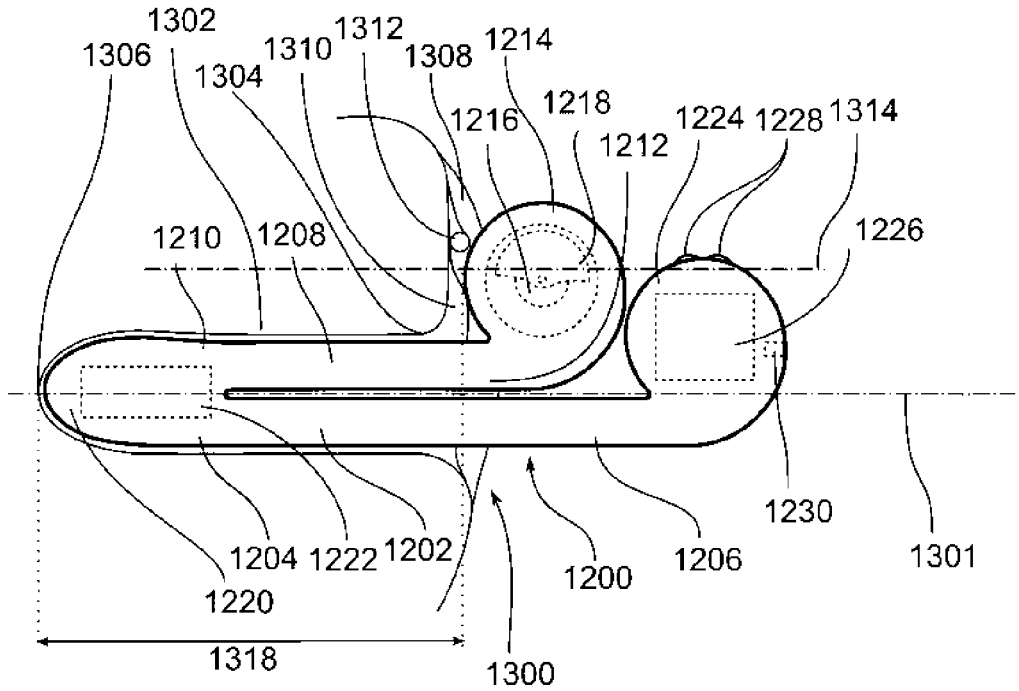
FIG. 12 is a side view of the device for massage, according to the sixth modification, in a final insertion stage into the vagina.

The implementation of the invention on the example of the sixth modification of the device. FIG. 11 shows the device for massage 1200 with the first elongate member 1202, with its first end 1204 and the second end 1206. A second elongate member 1208 having approximately the same thickness and cross-section as the first member, made with a curvilinear bend along an arc, with the first end 1210 and the second end 1212, smoothly changing into the stimulating member 1214 made in the form of body of revolution, with a transversely set fixed powerful vibrator 1216, with an eccentric mass 1218 mounted on its output shaft. The connection of the first member and the second member forms a convex rounded front end of the device 1220, inside which the vibrator 1222 is located. The second end of the first member 1206 enters the rounded handle 1224, in which the power supply and control unit 1226 is located, with the on/speed control buttons and modes 1228. At the rear end of the device there is a connector 1230 for connecting the charging device. In the initial stage of insertion, the device for massage 1200 is positioned in the area of the genitals of the woman 1300 in the direction 1301 of the vagina 1302 and inserted into the entrance in the vagina 1304 towards its fornix 1306. Thus, the stimulation member 1214 is positioned in the region of the clitoris 1308 along the labia 1310 and rests against the head of the clitoris 1312. Conventionally, the insertion axis 1301 and the displacement axis 1314 are shown, as well as the initial distance 1316 between the starting point of the stimulating surface and the front end of the device 1220. Conventionally shown is the intermediate position 1232 of the stimulating member 1214 and the direction of friction 1232 when moving the front end of the device 1220. FIG. 12 shows the same massage device in the final stage of insertion, in which the front end of the device 1220 moves along the insertion axis 1301 in the vagina 1302 by pushing the first member 1202 while holding the device 1200 by the handle 1224 by the hand of a user or partner. Thus, the stimulation member 1214 rests the clitoris region 1308 and the head of the clitoris 1312 and resiliently pushes the second member 1208, which is resiliently unbent along the first member 1202 and, which together with it forms the shape of an essentially dildo suitable for insertion and movement in the vagina. The arc of the second member 1208, as the device moves, spins up and the convex rounded stimulating surface of the stimulating member 1214 facing the clitoris 1308 region pivots on the head of the clitoris 1312, making continuous contact and friction stimulation. During the full insertion of the front end of the device 1220, the stimulating member 1214 rotates at an approximately unfolded angle relative to the axis of movement 1314 with a slight displacement relative to the axis of insertion 1301. Thus, the useful distance of insertion in which simultaneous stimulation of vaginal friction and clitoris occurs, is the difference between the initial distance 1316 (FIG. 11) and the final distance 1318. The user determines the required distance of the depth of insertion of the device 1200 and the amplitude of its movement, while affecting the amplitude and duration of the rotational reciprocating movements of the stimulating member 1214. When the front end of the device 1220 reaches the vaginal fornix 1306, the user imparts the device the reverse movement, in which the resilient of the second member 1208 imparts a rotation the return direction to the stimulating member 1214 and returns it to its initial position, in doing so, provides a pressure force to the stimulation member 1214 to the clitoris region 1308 and to the clitoris 1312. Additionally, the user has access to vibration functions both in the vagina and in the clitoris region, and the speed and modes of operation are selected by pressing the 1228 buttons.

Figure 13:
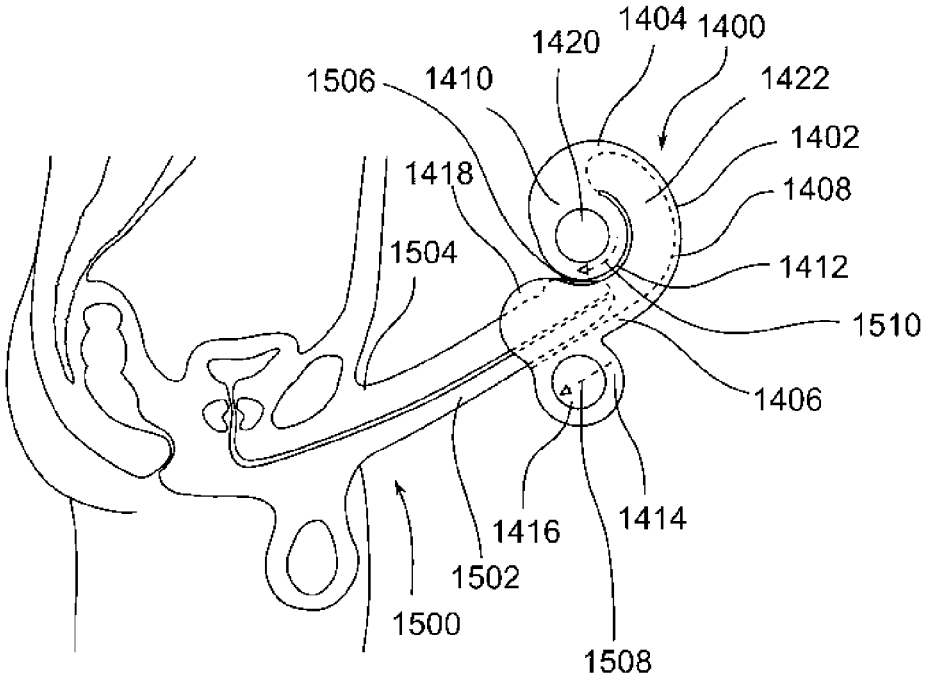
FIG. 13 is a side view of a device for massage, according to the seventh modification, in an initial movement stage along a penis.
Figure 14:
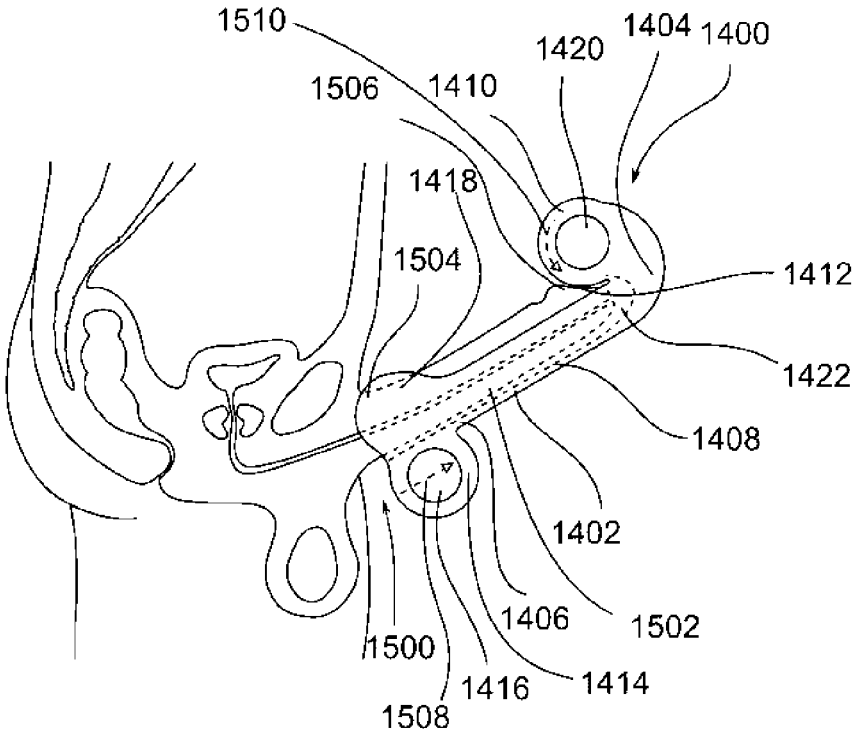
FIG. 14 is a side view of the device for massage, according to the sixth modification, in a final movement stage along the penis.

The implementation of the invention on the example of the seventh modification of the device. FIG. 13 shows a device for massaging the genitals 1400 with a first elongated arcuate member 1402 with a first end 1404 and a second end 1406 and a first surface portion 1408. The first end 1404 is connected to a second member 1410 with a second surface portion 1412. The second end 1406 is connected to an additional U-shaped member 1414 comprising a vibrator 1416 and wing-shaped elements bent inward 1418. The second member comprises a vibrator 1420. The first member is provided with a U-shaped longitudinal recess 1422, conventionally shown by a dotted line. In the initial stage of use, the device 1400 is put on the genitals 1500, on the shaft of the penis 1502 in the direction of its base 1504 so that the head of the penis is in contact with one side of the second surface portion 1412 of the second member 1410, and on the other side with the first surface portion the first member 1402 and is placed in a U-shaped recess 1422. The user holds the device by the additional member 1414 and moves it along the shaft of the penis 1502 towards its base 1504. The direction of movement of the first member 1508 and the direction of rotation of the second member 1510 are Conventionally shown. FIG. 14 shows the same device in the final stage of use, in which the first member 1402 is unfolded and the first portion of the surface 1408 takes the shape of an erect penis. The additional member 1414 shifting toward the base of the penis 1504, and the wing members 1418 hold and direct the movement of the device over the penis. In this way, the second surface portion 1412 is pressed against the head of the penis and is rotated thereon, thus providing interaction just as the first surface portion 1408 interacts with the shaft of the penis.

The implementation of the invention is not limited to the description, but is considered on the basis of the understanding of the state of the art by the person skilled in the art, including indications to all necessary electromechanical parts of the device, printed circuit boards, microprocessors, communication means, software, as well as functional connections between the components of the device. These embodiments are preferred and do not limit its implementation, any combinations of technical solutions, features, the members and means listed in the specification and claims may be embodied in a single device depending upon the ability of the combination thereof, description of their combinations in a single device is a recommendation character, which is not restrictive of the implementation in another device of the same purpose, any modifications and improvements should be considered within the scope of the invention.

The invention claimed is:

1. A device for massage of the genitals, comprising: a first elongated member, a second elongated member, and a stimulating member;

the second elongated member is elongated with a first end and a second end; the second end of the second elongated member is connected to the stimulating member; the first end of the second elongated member is connected to the first elongated member; the second elongated member is made with a curvilinear bend; the second elongated member comprises a first surface portion adapted to act on a first genital portion;

the stimulating member comprises a second surface portion adapted to act on a second genital portion;

the first elongated member is adapted to move the first end of the second elongated member along the first genital portion; the first surface portion is made elongated, with a curvilinear bend and with the ability of a translational movement along the first genital portion; the second elongated member is adapted to resiliently unbend in a progress of the translational movement and thereby give the first surface portion, essentially a shape of the first genital portion; the second elongated member is adapted to resiliently press the second surface portion to the second genital portion in the process of the translational movement, wherein the first genital portion is a vagina, and the second genital portion is a clitoris and an area of the clitoris, wherein the first elongated member is elongated with a first end and a second end of the first elongated member, the first end of the first elongated member is connected to the first end of the second elongated member, the second elongated member and the first elongated member adapted to joint insertion of their respective ends into the vagina and wherein the first elongated member is adapted to push the second elongated member in the vagina by the first end of the second elongated member and, thereby unbending the second elongated member essentially along the first elongated member, when the stimulating member is pressed into the area of the clitoris.

2. The device of claim 1, wherein the second elongated member is adapted to move the stimulating member from a first position at which the stimulating member is close to the first end of the first elongated member, to a second position at which the stimulating member is close to the second end of the first elongated member, in the progress of resilient unbending of the second elongated member, essentially along the first elongated member.

3. The device of claim 1, wherein the second surface portion is made convex with the ability of rotational movement along the second genital portion in the process of the translational movement.

4. The device of claim 1, wherein the second elongated member and the first elongated member are made with the ability to form essentially a penis shape in the process of the translational movement by the first member on the first body region.

5. The device of claim 1, wherein the first surface portion is made with the ability of reciprocating movement along the first genital portion.

6. The device of claim 1, wherein the second surface portion is made with the ability of rotational reciprocating movement along the second genital portion.

7. The device of claim 1, wherein the first surface portion is made with the ability of reciprocating movement along the first genital portion and the second surface portion is made with the ability of rotational reciprocating movement along the second genital portion, wherein these movements essentially are synchronous.

8. The device of claim 1, wherein the stimulating member is elastically connected to the second end of the second elongated member.

9. The device of claim 1, wherein the stimulating member is rotationally connected to the second end of the second elongated member.

10. The device of claim 1, wherein the device is adapted to massage by vibration or rubbing or heating on the first genital portion.

11. The device of claim 1, wherein the device is adapted to massage by vibration or rubbing or heating or vacuum stimulation on the second genital portion.

12. The device of claim 1, wherein the first surface portion is arcuate, the second surface portion is arcuate and the centers of their arcuate surfaces essentially coinciding.

13. The device of claim 1, wherein, the first elongated member and the second elongated member are made of resiliently deformable material the second elongated member is designed with an arcuate bend with an essentially semicircular cross-section and the first elongated member is designed with essentially such same cross-section, the stimulation member being resiliently connected to the second end of the second elongated member and comprising a first electromechanical means for creating mechanical vibrations, the second end of the first elongated member is connected to a handle for holding the device and the first elongated member comprises an inner rigid body, extending from a connection of the first ends of the first elongated member and the second elongated member in which second electromechanical means for creating mechanical vibrations is mounted, to the handle in which a reusable power supply means is mounted, control means, and means for connecting to an external power supply, wherein the second electromechanical means, the reusable power supply, the control means and the means for connecting to the external power supply are coupled to each other.

14. A method of massage of the genitals, comprising the steps of: providing the device of claim 1, and inserting the device into the vagina to simultaneously affect the vagina and the clitoris.

* * * * *